United States Patent [19]

Matthews

[11] 4,131,412

[45] * Dec. 26, 1978

[54] FUEL IGNITION SYSTEM HAVING INTERLOCK PROTECTION AND ELECTRONIC VALVE LEAK DETECTION

[75] Inventor: Russell B. Matthews, Goshen, Ind.

[73] Assignee: Johnson Controls, Inc., Milwaukee, Wis.

[ * ] Notice: The portion of the term of this patent subsequent to Jul. 12, 1994, has been disclaimed.

[21] Appl. No.: 774,959

[22] Filed: Mar. 7, 1977

Related U.S. Application Data

[63] Continuation-in-part of Ser. No. 621,670, Oct. 14, 1975, Pat. No. 4,035,134.

[51] Int. Cl.[2] ..... F23Q 9/12

[52] U.S. Cl. ..... 431/16; 431/22; 431/46

[58] Field of Search ..... 431/16, 22

[56] References Cited

U.S. PATENT DOCUMENTS

| | | | |
|---|---|---|---|
| 3,086,583 | 4/1963 | Reichow | 431/22 |
| 3,194,296 | 7/1965 | Brown | 431/22 |
| 3,840,322 | 10/1974 | Cade | 431/78 |
| 4,035,134 | 7/1977 | Matthews | 431/22 |
| 4,047,878 | 9/1977 | Matthews | 431/22 |

*Primary Examiner*—Carroll B. Dority, Jr.

*Attorney, Agent, or Firm*—Emrich, Root, O'Keeffe & Lee

[57] ABSTRACT

A fuel ignition system of the pilot ignition type including a control circuit for operating pilot and main valves of a redundant valve assembly, the control circuit having control relays which provide an interlock on start-up to prevent the energization of the valves under certain failure conditions, the control circuit including a flame sensing circuit which is operable to prevent start-up of the system when a flame is provided as the result of a leak condition for the pilot valve, and to terminate an ignition cycle causing complete shut off of fuel whenever a flame is provided as the result of a leak condition for the main valve.

15 Claims, 1 Drawing Figure

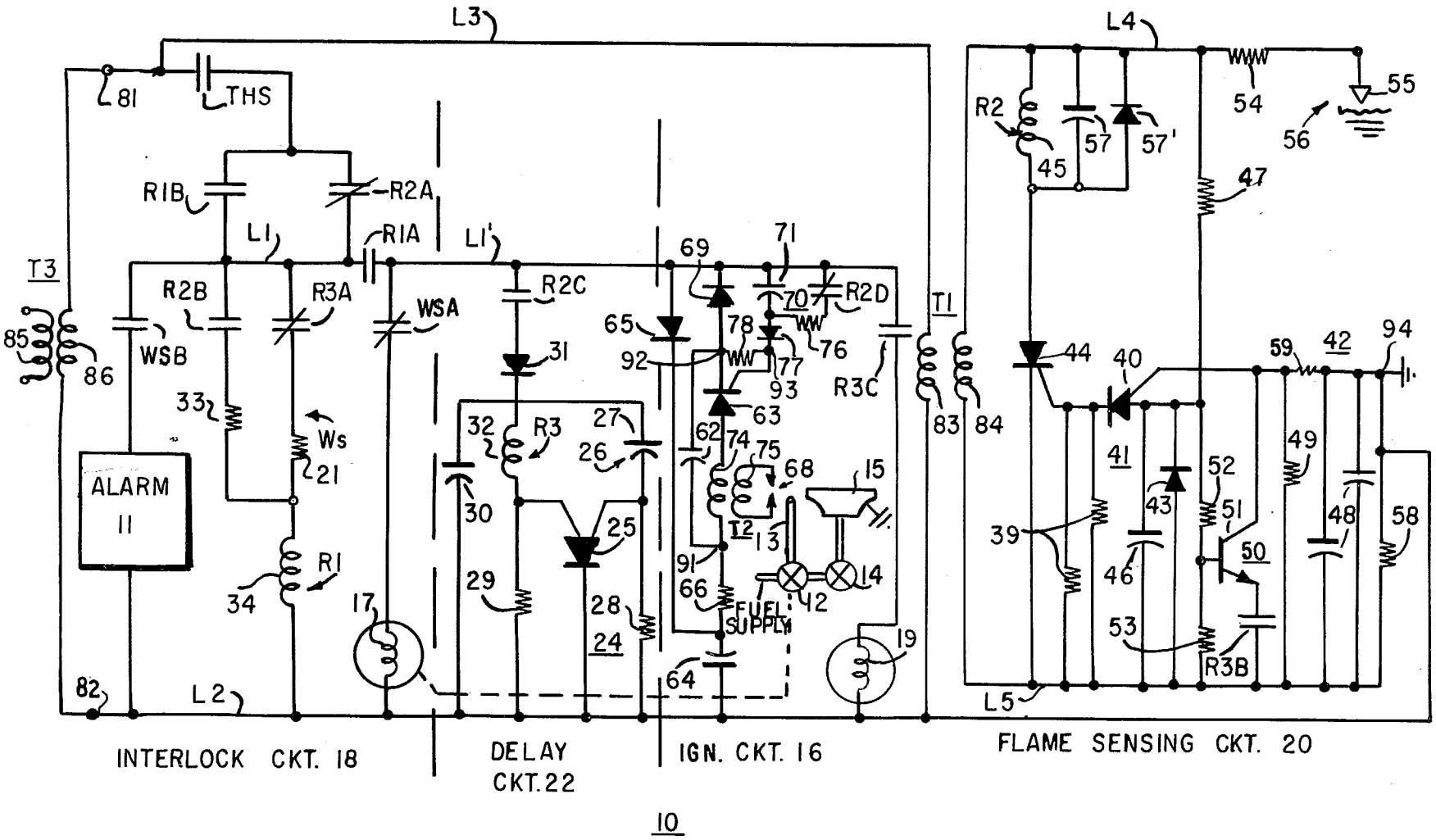
FLAME SENSING CKT. 20
IGN. CKT. 16
DELAY CKT. 22
INTERLOCK CKT. 18
ALARM 11
FUEL SUPPLY
10

FUEL IGNITION SYSTEM HAVING INTERLOCK PROTECTION AND ELECTRONIC VALVE LEAK DETECTION

RELATED APPLICATIONS

This is a continuation-in-part application of copending application Ser. No. 621,670, now U.S. Pat. No. 4,035,134, issued July 12, 1977. As to common subject matter, applicant claims the benefit of the priority date of said patent under 35 U.S.C. 120.

BACKGROUND OF THE INVENTION

1. Field of the Invention

This invention relates to fuel ignition systems of the pilot ignition type and more particularly, to a control circuit for use in such systems for providing an interlock on start-up under certain failure conditions.

2. Description of the Prior Art

In known fuel ignition systems of the pilot ignition type, a pilot valve is operated in response to the closure of thermostatically controlled contacts to supply fuel to a pilot outlet for ignition by a suitable igniter to establish a pilot flame. A pilot flame sensing circuit detects the pilot flame and effects the energization of a main valve which supplies fuel to a main burner apparatus for ignition by the pilot flame.

Typically, the operation of the main valve is controlled by a relay of the flame sensing circuit which has normally open contacts connected in the energizing path for the main valve to maintain the main valve deenergized until a pilot flame is established. When a pilot flame is established, the flame sensing circuit energizes the relay which closes its contacts to connect the main valve to an energizing circuit to permit the main valve to operate.

After the heating demand has been met, the thermostatically controlled contacts open to effect deenergization of the fuel valves and cause the flame to be extinguished. The flame sensing circuit responsively causes the relay to be deenergized, opening its contacts to disconnect the main valve from the energizing circuit in preparation for the next heating cycle. However, should the relay contacts which control the energization of the main valve become welded together following a successful ignition cycle, then, when the relay is deenergized, the main valve remains connected to the energizing circuit and will be energized when the thermostatically controlled contacts close in response to the call for heat, even though a pilot flame is not established. Similarly, the main valve will also be connected to the energizing circuit for a circuit failure which permits the relay of the flame sensing circuit to be energized in the absence of a pilot flame. For such failure conditions, both the pilot valve and the main valve will be energized when the thermostatically controlled contacts close, permitting fuel to emanate from the pilot outlet and the main burner, an undesireable condition.

Various interlock arrangements have been proposed in the prior art as exemplified by the U.S. Pat. Nos. 3,449,055 to L.C. Blackett, 3,644,074 to P.J. Cade and 3,709,783 to J.S. Warren, in which the energization of the fuel valves of the system is dependent upon the sequential operation of relays. In the systems disclosed in the patents referenced above, the energization of the pilot valve is effected in response to the operation of a control relay which can be energized only if the flame relay is deenergized. Thereafter, the energization of the main valve is effected in response to the operation of a flame relay when a pilot flame is established, but only if the control relay is energized.

While such interlock circuits guard against the welded contact failure referred to above, it appears that the control (or flame) relay may be energized inadvertantly following a failure of a solid state control device of the electronic circuits, allowing the main valve to operate in the absence of a pilot flame. Also, in the patented systems, the flame sensing circuit is energized in response to the operation of a control device, such as a thermostat. Thus, in the event of a leak condition for a fuel valve of the system, which permits a flame to remain establish after the system is deactivated, it would appear that under certain failure conditions, the flame sensing circuit would be ineffective to lockout the system before the control relay operated.

In the U.S. Pat. No. 3,840,322 to Philip J. Cade, there is disclosed an automatic fuel ignition control system which effects lock out of the system whenever a flame is provided at a burner apparatus before the end of an ignition timing interval. However, the system will also be locked out following a loss of flame during a heating cycle or in the event of a line voltage interruption of a very short duration, wherein the pilot frame is not extinguished before power is restored.

In my U.S. Pat. Application Ser. No. 621,670, filed Oct. 14, 1975 and now U.S. Pat. No. 4,035,134, there is disclosed a proven pilot fuel ignition system including a control arrangement which provides an interlock on start-up to prevent the energization of fuel valves of the system under certain failure conditions. The control arrangement also detects a leak condition for pilot and main valves of the system, effecting shut down of the system for a leak condition for either valve, but permitting recycling of the system following a momentary power loss or a flame out condition.

The control arrangement includes a delay circuit which effects operation of a control relay to allow energization of the pilot valve and a flame sensing circuit ater a first delay following the activation of the system. If a flame is established at the time the flame sensing circuit is energized, the flame sensing circuit causes the system to be locked out. Such timing control is afforded by a timing circuit of the flame sensing circuit which requires absence of a flame for a time after the flame sensing circuit is energized before a flame relay of the flame sensing circuit is allowed to operate. Under normal conditions, the delay circuit is disabled under the control of the flame relay and effects energization of the main valve after a second delay interval after the pilot flame is established. The flame sensing circuit prevents operation of the main valve if a main burner flame is sensed during the second delay interval. An interlock circuit prevents enabling of the delay circuit and the control relay at start up for certain failure conditions, including welded contacts of the flame relay.

SUMMARY OF THE INVENTION

The present invention has provided a control circuit for use in a fuel ignition system of the pilot ignition type which provides an interlock on start-up to prevent energization of fuel valves of the system under certain failure conditions. The system includes a pilot valve operable when energized to supply fuel to a pilot outlet for ignition to establish a pilot flame, a main valve operable when energized to supply fuel to a burner apparatus for ignition by the pilot flame, and a control circuit which controls the operation of the fuel valves The control circuit includes interlock means including first switching means operable when enabled to energize the pilot valve, flame sensing means for causing a second switching means to be enabled whenever a pilot flame is provided, and delay means responsive to the second switching means to effect the energization of the main valve at the end of a time interval, the flame sensing means preventing the energization of the main valve and causing the pilot valve to be deenergized if a flame is provided at the burner apparatus during the time interval, indicative of a leak condition for the main valve. Also, the flame sensing means controls the second switching means to prevent the first switching means from being enabled, locking out the system, if a pilot flame is provided at the onset of the trail for ignition interval, indicative of a leak condition for the pilot valve.

More specifically, in accordance with a disclosed embodiment, the pilot valve and the main valve comprise a redundant valve structure in which fuel is supplied to the main valve through the pilot valve only when the pilot valve is operated. The pilot valve is energized by the first switching means of the interlock means, which in turn is energized over a first circuit path in response to an activate means, such as a thermostatically controlled switch, and operates to complete a second circuit path for energizing the pilot valve. The first switching means is energized over the first circuit path during a trial for ignition period defined by a timeout device of the interlock means. The timeout device is operable to deenergize the pilot valve of the redundant valve assembly if a pilot flame fails to be established during the trial for ignition interval, providing 100% shut off of fuel. The time-out device is initially energized over the first circuit path, and if such path is interrupted at start-up, the system cannot be activated.

When a pilot flame is established, the flame sensing means, which is continuously energized, responds to the flame to enable the second switching means which connects the delay means to the second circuit path for energization. The delay means includes third switching means which is operable when enabled to connect the main valve to the second circuit path for energization, and an enabling means which delays the enabling of the third switching means for a predetermined time after the delay means is energized. If a flame is provided at the burner apparatus during such delay interval, as due to a leak condition for the main valve, for example, the ignition cycle is terminated before the main valve is allowed to operate, and the system is locked out.

In accordance with the invention, the switching means which may comprise relays or some other contact operating switch device, afford a contact interlock protection which guards against unsafe failures including component failures, welded contacts, or a leak condition for either one of the valves. If for any reason the first switching means fails to operate before either the second or third switching means operates, a start-up of an ignition cycle is prevented, and both valves are maintained deenergized. Also, once an ignition cycle is started, the system may be locked out, under certain failure conditions including a leak condition for the main valve.

DESCRIPTION OF THE DRAWING

The single FIGURE is a schematic circuit diagram for a control circuit provided by the present invention for use in a fuel ignition control system of the pilot ignition type.

DESCRIPTION OF A PREFERRED EMBODIMENT

Referring to the drawing, there is illustrated a schematic circuit diagram for a fuel ignition control circuit 10 provided by the present invention. The control circuit 10 is described with reference to an application in a heating system of the pilot ignition type which includes a pilot valve 12 and a main valve 14. The pilot valve 12 and the main valve 14 may comprise a redundant valve assembly in which fuel is supplied to the main valve 14 through the pilot valve 12, and thus only when the pilot valve 12 is operated. One redundant valve structure suitable for this application is disclosed in my U.S. patent application Ser. No. 630,166, which was filed on Nov. 10, 1975 and now U.S. Pat. No. 4,044,794.

The pilot valve 12 is operable to supply fuel to an inlet of the main valve 14 and to a pilot outlet 13 for ignition by sparks provided by an igniter circuit 16 to establish a pilot flame in the proximity of a burner apparatus 15. The main valve 14 is operable to supply fuel to the main burner apparatus 15 for ignition by the pilot flame. Due to the redundant valve structure, fuel can be supplied to the burner apparatus 15 only when both the pilot valve 12 and the main valve 14 are operated.

The pilot valve 12 and the igniter circuit 16 are energized by an interlock circuit 18 which includes a first switching device or actuator, embodied as a relay R1, which is operable to complete an energizing path for a solenoid 17 of the pilot valve 12 and the igniter circuit 16. The relay R1 is energized during a trial for ignition period initiated by the closing of thermostatically controlled switch contacts THS in response to a request for heat. The interlock circuit 18 includes a timeout device, embodied as a warp switch WS, which defines the trial for ignition period and is operable to deenergize the pilot valve 12 of the redundant valve assembly if a pilot flame fails to be established during the trial for ignition period, thereby terminating the ignition cycle and providing 100% shut off of fuel to the burner apparatus 15. The warp switch WS also enables an alarm device 11 to indicate that the system is locked out.

The main valve 14 is energized under the control of a flame sensing circuit 20 and a delay circuit 22. When a pilot flame is established, the flame sensing circuit 20 responds to the flame to operate an associated second switching device or actuator, embodied as a relay R2, which completes an energizing path for the delay circuit 22. The delay circuit 22 includes a third switching device or actuator, embodied as a relay R3, which is operable to complete an energizing path for the main valve 14. The delay circuit 22 also includes an enabling circuit 24, which delays the enabling of relay R3 for a predetermined time after the delay circuit 22 is energized. If a flame is provided at the burner apparatus 15 during such delay interval, as due to a leak condition for the main valve 14, the ignition cycle is terminated before the main valve 14 is allowed to operate, and the system is locked out.

In accordance with the invention, relays R1–R3 afford a contact interlock protection which guards against unsafe failures including component failures, welded relay contacts, or a leak condition for either one of the valves. If for any reason relay R1 fails to operate before relays R2 or R3 operate, a start-up of an ignition cycle is prevented, and both the pilot valve and the main valve are maintained deenergized. Also, once an ignition cycle is started, the system may be locked out, under the control of the warp switch WS, in the event of certain failure conditions including a leak condition for the main valve 14.

More specifically, referring to the interlock circuit 18, the interlock relay R1 and a heater element 21 of the warp switch WS are energized over a circuit path which includes normally closed contacts R2A and R3A of relays R2 and R3, respectively. Thus, relay R1 and the warp switch heater 21 can be initially energized only when relays R2 and R3 are deenergized. When energized, relay R1 closes contacts R1A to complete an energizing path for the pilot valve solenoid 17 over normally closed contacts WSA of the warp switch WS, permitting the pilot valve 12 to open to supply fuel to the pilot outlet 13. The igniter circuit 16 is also energized to provide sparks for igniting the pilot fuel. Relay R1 also closes contacts R1B to prepare a holding path to permit the relay R1 and the warp switch heater 21 to be maintained energized when relay R2 operates to open contacts R2A, contacts RIB being connected in shunt with contacts R2A.

Relay R2 is operated under the control of the flame sensing circuit 20 when a pilot flame is established, to open contacts R2A and to close contacts R2B, which complete the holding path for relay R1, the warp switch heater 21 being maintained energized over normally closed contacts R3A of relay R3, which is deenergized at this time. Relay R2 also closes contacts R2C to energize the delay circuit 22 and opens contacts R2D to disable the igniter circuit 16.

The flame sensing circuit 20 includes a controlled switching device, embodied as a programmable unijunction transistor 40, which together with associated timing networks 41 and 42, effect the enabling of a further controlled switching device, embodied as a silicon controlled rectifier 44, which controls the operation of relay R2. The timing, or anode control network 41, which includes a timing capacitor 46, determines the potential at the anode electrode of the PUT device 40. The timing, or gate control network 42, which includes redundant timing capacitors 48, determines the potential at the gate of the PUT device 40.

The PUT device 40 is enabled whenever the potential at its anode exceeds the potential at its gate by +0.6 volts. Capacitor 46, which determines the potential at the anode of the PUT device 40, is periodically charged over a resistor 47 by an AC signal which is continuously supplied to the flame sensing circuit 20 over an isolation transformer T1. In the absence of a flame, capacitors 48 remain essentially uncharged, such that the enabling of the PUT device 40 is effectively controlled by the charging of capacitor 46. When the PUT device 40 is enabled, capacitor 46 discharges into the gate of the SCR device 44. However, in the absence of a flame, the discharge current is insufficient to enable the SCR device 44, and the relay R2 remains deenergized.

For the purpose of permitting relay R2 to be energized when a flame is established, the flame sensing circuit 20 further includes a flame sensor, embodied as a sensing electrode 55, which is located in the proximity of the burner apparatus 15 and the pilot outlet 13 in a spaced relationship with the burner apparatus 15 defining a gap 56.

When fuel supplied to the pilot outlet or main burner apparatus is ignited, the flame bridges the gap 56, establishing a charging path for the capacitors 48, permitting the capacitors 48 to charge while capacitor 46 is charging. Although capacitor 46 charges at a faster rate, the charging or capacitors 48 raises the potential at the gate of the PUT device 40 so that a longer time is now required before the potential at the anode exceeds the potential at the gate by +0.6 volts. Thus, when the PUT device 40 is enabled, the capacitor 46 has been charged to a value which provides sufficient discharge current to enable the SCR device 44, causing the relay R2 to be energized.

It is pointed out that since the flame sensing circuit 20 is continuously energized, relay R2 is operated whenever a flame is provided at the pilot outlet 13. Thus, when the control circuit is deactivated by the opening of contacts THS at the end of each heating cycle, relay R2 will remain operated with contacts R2A open in the event of a leak condition for the pilot valve 12 which permits a flame to remain established at the pilot outlet when the pilot valve is deenergized. Accordingly, when contacts THS close on the next call for heat, the energizing path for relay R1 is interrupted and the system cannot restart.

The flame sensing circuit 20 further includes an oversignal clamping circuit 50, including transistor 51 which is normally disabled by normally open contacts R3B of relay R3. Whenever a large flame is provided at the main burner apparatus 15 before relay R3 operates, indicative of a leak condition for the main valve 14, the oversignal clamping circuit 50 causes the PUT device 40 to be maintained cutoff, causing deenergization of the relay R2 and allowing the warp switch WS to effect the shut down of the system.

As indicated above, when relay R2 operates, its contacts R2C close to enable the delay circuit 22 and its contacts R2D open to disable the igniter circuit 16. Briefly, as described in more detail hereinafter, the igniter circuit 16 is of the capacitor discharge type, having a capacitor 62 which is periodically charged by an AC signal supplied over normally closed contacts R2D of relay R2, and a controlled switching device, embodied as a silicon controlled rectifier 63, which is operable to cause the capacitor 62 to discharge over an ignition transformer T2 to effect the generation of sparks between ignition electrodes 68. The ignition electrodes 68 are located adjacent to the pilot outlet 13 to ignite the pilot fuel emanating therefrom.

When relay R2 operates to open contacts R2D, the capacitor 62 is permitted to be charged periodically for a time determined by a timing network 70 including a timing capacitor 71, whereby the igniter circuit 16 continues to provide sparks for a time after relay R2 operates.

Referring to the delay circuit 22, the enabling circuit 24 includes a controlled switching device, embodied as a programmable unijunction transistor 25, which is operable when eanbled to complete an energizing path for relay R3. The enabling circuit 24 further includes a timing network 26 including a capacitor 27, which controls the enabling of the PUT device 25. The capacitor 27 is permitted to charge in response to activation of the delay circuit 22 following the closing of contacts R2C of relay R2 and, after a delay established by the charging time of capacitor 27, the PUT device 25 is enabled, causing relay R3 to operate to close contacts R3C, effecting the enabling of the main valve 14. Also, contacts R3A open to deenergize the warp switch heater 21 and contacts R3B close enabling the over-signal clamping circuit 50 of the flame sensing circuit 20.

Contacts R3A of relay R3 permit the warp switch heater 21 to remain energized from the time that contacts THS close until after the delay establishing by the enabling circuit 24 at which time relay R3 operates to energize the main valve 14. Thus, in the event of an unsafe failure which prevents the operation of the relay R3 before the heating time of the warp switch heater 21, the warp switch WS operates to open contacts WSA, deenergizing the pilot valve 12, effecting 100% shut off of fuel supply to the burner and causing the system to be locked out. The warp switch WS also closes contacts WSB to enable the alarm device 11 to indicate the lock-out condition for the system.

Operation

Briefly, in operation, when the thermostatically controlled contacts THS close in response to a request for heat, the warp switch heater 21 and the relay R1 are energized over the normally closed contacts R2A annd R3A of respective relays R2 and R3. The energization of the warp switch heater 21 permits the system to be maintained activated for a trial for ignition period defined by the heating time of the warp switch heater 21. Relay R1 operates to close contacts R1B to prepare a holding path for the relay R1 and the warp switch heater 21, and to close contacts R1A to complete an energizing path for the pilot valve 12 which operates to supply fuel to the pilot outlet 13. The igniter circuit 16 is also energized to generate sparks for igniting the fuel supplied to the pilot outlet 13.

When a pilot flame is established during the trial for ignition period, the flame sensing circuit 20 causes the relay R2 to operate to close contacts R2C to energize the delay circuit 22 and to open contacts R2D to disable the igniter circuit 16. Relay R2 also opens contacts R2A interrupting the energizing path for the relay R1 and closes contacts R2B to complete a holding path for relay R1.

After the time delay established by the delay circuit 22, relay R3 is energized closing contacts R3C to permit the main valve 14 to operate, and opening contacts R3A to deenergize the warp switch heater 21. When the heating demand has been met and contacts THS open, relays R1 and R3 and deenergized and the fuel valves drop out, interrupting the supply of fuel to the burner and the pilot outlet, causing the flame to be extinguished. The flame sensing circuit 20 responds to the loss of flame to deenergize relay R1 which releases opening contacts R1A, and the circuit 10 is ready for the next heating cycle.

If a pilot flame fails to be established during the trial for ignition period, the warp switch WS operates to open contacts WSA deenergizing the pilot valve 12 thereby interrupting the supply of fuel to the pilot outlet 13 as well as to the main valve 14, causing the system to become locked out. The warp switch WS also closes contacts WSB to enable the alarm device 11 to indicate that the system is locked out.

If relay R2 remains operated following the deactivation of the system, such as due to a leak condition for the pilot valve 12 which permits a flame to remain established when the pilot valve 12 is deenergized, or for a malfunction of the flame sensing circuit 20 which causes relay R2 to be operated in the absence of a flame, then contacts R2A will remain open, preventing start-up on the next call for heat. Also a leak condition for the main valve 14 will permit fuel to be supplied to the main burner 15 before the main valve is energized. Under such conditions the fuel will be ignited by the pilot flame causing the oversignal clamping circuit 50 to effect the disabling of relay R2, preventing the enabling of relay R3. Accordingly, the warp switch WS will time out, deactivating the control circuit 10 with the pilot valve 12 deenergized, providing 100% shut off of fuel.

DETAILED DESCRIPTION

Considering the fuel ignition control circuit 10 in more detail, the circuit 10 has a pair of input terminals 81 and 82 which are connectable to a 24 VAC source for supplying power to the circuit 10. Terminal 81 is connected over normally open contacts THS and over normally closed contacts R2A of relay R2 to a conductor L1, and terminal 82 is connected to a conductor L2. The 24 VAC energizing signal may be supplied to the control circuit 10 over a transformer T3, having a primary winding 85 connected to a source of power and a secondary winding 86 connected across terminals 81 and 82.

Referring to the interlock circuit 18, the heater element 21 of the warp switch WS and an operate coil 34 of relay R1 are connected in series between conductors L1 and L2 over normally closed contacts R3A of relay R3 for energization in response to the closing of contacts THS and whenever relays R1 and R3 are disabled. Relay R1 has normally open contacts R1B connected in a shunt path with contacts R2A to prepare a holding path for relay R1 when relay R2 operates to open contacts R2A. Relay R1 also closes contacts R1A to extend power to a conductor L1' to permit energization of the pilot valve 12, the delay circuit 22 and the igniter circuit 16.

To operate coil 17 of the pilot valve 12 is connected over normally closed contacts WSA of the warp switch WS between conductors L1' and L2 and is energized whenever contacts R1A close, permitting the pilot valve 12 to operate to supply fuel to the pilot outlet 13 and to the inlet of the main valve 14. The warp switch WS also has normally open contacts WSB connected in series with the alarm device 11 between conductors L1 and L2.

To operate coil 19 of the main valve 14 is connected over normally open contacts R3C of relay R3 between conductors L1' and L2 and is energized when relay R3 operates to operate the main valve 14, supplying fuel to the main burner apparatus 15 for ignition by the pilot flame.

Considering the delay circuit 22, the PUT device 25 has an anode control network including the operate coil 32 of relay R3 and a resistor 29, which serve as a voltage divider circuit to establish a potential at the anode of the PUT device 25 when contacts R2C close to extend AC power from conductor L1' to the delay circuit 22. The operate coil 32 and resistor 29 are connected between conductors L1' and L2 in a series circuit with normally open contacts R2C and a diode 31, which extends from conductor L1' over contacts R2C, diode 31, and the winding 32 to the anode of the PUT device 25, and over resistor 29 to conductor L2. A capacitor 30 is connected in parallel with winding 32 and resistor 29.

The PUT device 25 has a gate control network including capacitor 27 and resistor 28 which together with diode 31 form a unidirectional series charging path for capacitor 27 which extends from conductor L1' over contacts R2C, diode 31, capacitor 27 and resistor 28 to conductor L2. The junction of capacitor 27 and resistor 28 is connected to the gate of the PUT device 25. The cathode of the PUT device 25 is connected directly to conductor L2, and thus, the PUT device 25 has its anode-cathode circuit connected in series with the operate coil 32 of relay R3 and diode 31 between conductors L1' and L2 and is operable when enabled to effect the energization of the relay R3. When energized, relay R3 closes contacts R3C to energise the main valve 14 and opens contacts R3A to deenergize the wrap main vlave switch heater 21. Relay R3 also closes contacts R3B to enable the over signal clamping circuit 50.

The PUT device 25 is enabled when the potential at its anode exceeds the potential at its gate by +0.6 volts. Thus, when capacitor 27 has charged to a value that causes the potential at the gate of the PUT device 25 to be 0.6 volts less than the potential at the anode of the PUT device 25, the PUT device 25 is enabled, energizing the relay R3. Thereafter, the PUT device 25 is enabled during each positive half cycle of the AC signal, the relay R3 being maintained energized during the negative half cycles by capacitor 30.

Referring to the igniter circuit 16, capacitor 62 is charged and then discharged over the primary winding 74 of the ignition transformer T2 during alternate half cycles of the AC signal, to provide sparks between a pair of ignition electrodes 68 which are connected to the secondary winding of the transformer T2. The ignition electrodes 68 are disposed adjacent to the pilot outlet 71 is a spaced relationship, providing a gap therebetween.

The igniter circuit 16 includes a voltage doubler circuit including capacitor 64 which supplies a voltage to capacitor 62, enabling the capacitor 62 to be charged to approximately twice the line voltage supplied over conductors L1' and L2. Capacitor 64 has a charging path which extends from conductor L1' over a diode 65 and the capacitor 64 to conductor L2. Capacitor 64 is charged when conductor L1' is positive relative to conductor L2 during positive half cycles of the AC line signal.

Capacitor 62 charges during negative half cycles of the AC line signal, that is when conductor L2 is positive with respect to conductor L1', over a path which extends from conductor L2 over capacitor 64 and a resistor 66 to one side of capacitor 62 at point 91, and from the other side of the capacitor 62 at point 92 over a diode 69 to conductor L1'.

The SCR device 63 has its anode connected to conductor L2 over the primary winding 74 of transformer T2, resistor 66, and capacitor 64, and its cathode connected to conductor L1' over diode 69. When relay R2 is deenergized, a gate control circuit is provided for the SCR device 63 over normally closed contacts R2D of relay R2, and resistor 76, diode 77, and resistor 78 which are connected between conductor L1' and point 92. Capacitor 71 of the timing network 70 is connecgted in shunt with contacts R2D and resistor 76 to provide an alternate gate control circuit for the SCR device 63 when relay R2 is operated.

The gate of the SCR device 63 is connected to the junction of the cathode of diode 77 and resistor 78 at point 93 to permit the SCR device 63 to conduct whenever the potential at point 93 exceeds the gate threshold of the SCR device 63.

The flame sensing circuit is continuously energized by an AC signal supplied to conductors L4 and L5 over transformer T1. The transformer T1 has a primary winding 83 having one end connected over a conductor L3 to terminal 81, and having its other end connected to conductor L2. The transformer T1 has a secondary winding 84 connected between conductors L4 and L5.

The anode control network 41 for the PUT device 40 includes capacitor 46 and a resistor 47 which are connected in series between conductors L4 and L5, providing a charging path for the capacitor 46. The anode of the PUT device 40 is connected to the junction of resistor 47 and capacitor 46. A diode 43 which is connected in parallel with capacitor 46, provides a bypass path for capacitor 46 during negative half cycles of the AC signal.

The gate control network 42 includes capacitors 48 and resistors 58, 49 and 59. Resistor 49 is connected between the gate of the PUT device 40 and conductor L5, and resistor 59 is connected between the gate of the PUT device 40 and the ground point for the control circuit 10 at point 94, which is also connected to conductor L2. Capacitors 48 are connected in parallel between point 94 annd conductor L5 and a bleeder resistor 58 is connected in parallel with capacitors 48.

The flame sensing electrode 55 and resistor 54 form a portion of the gate control network 42 for the PUT device 40. The sensing electrode 55 is connected over resistor 54 to conductor L4, with the electrode 55 being positioned in a spaced relationship with the ground reference point 94 for the conrol circuit 10, normally providing a high resistance path, virtually an open circuit, between conductor L4 and the reference point 94. As indicated above, the ground reference point 94 may be a metallic ground provided by the burner apparatus 15.

The sensing electrode 55 is located adjacent to the pilot outlet 13 and one end of the burner 15 in the region in which a flame is to be provided such that either a pilot or main burner flame bridges the gap 56 between the electrode 55 and the reference point 94, thereby lowering the resistance of the circuit path including resistor 54 over the electrode 55 between conductor L4 and the reference point 94 whenever a flame is established. Thus, whenever a flame bridges the gap 56, the high resistance charging path is provided for capacitors 48, allowing the capacitors 48 to charge.

The cathode of the PUT device 40 is connected to the gate of the SCR device 44 and over redundant resistors 39 to conductor L5. Thus, whenever the PUT device 40 is rendered conductive, a discharge path is provided for capacitor 46 over the anode-cathode circuit of the PUT device 40 to the gate of the SCR device 44.

The PUT device 40 is rendered conductive whenever the potential at its anode exceeds the potential at its gate by +0.6 volts, as determined by the action of networks 41 and 42. For the condition where a pilot flame is not established, the PUT device 40 conducts early in the positive half cycles of the AC signal and before capacitor 46 is charged to a value sufficient to effect enabling of the SCR device 44. When a pilot flame is established, the PUT device 40 conducts at a later time during the positive half cycles when the capacitor 46 is charged to a value which is sufficient to render the SCR device 44 conductive.

The SCR device 44, which controls the energization of the relay R2, has its anode connected to one side of the operate winding 45 of the relay R2, the other side of which is connected to conductor L4. The cathode of the SCR device 44 is connected to conductor L5 so that when the SCR device 44 is enabled, the operate winding 45 of relay R2 is connected between conductors L4 and L5, permitting the relay to operate.

The PUT device 40, which controls the enabling of the SCR device 44, is pulsed into operation, providing an enabling pulse for SCR device 44 for each cycle of the AC signal during the trial for ignition interval. During the portion of the AC cycle when the SCR device 44 is non-conducting, the relay R2 is maintained energized by capacitor 57 and free-wheeling diode 57' which are connected in parallel with the operate winding 45 of relay R2.

Considering the over-signal clamping circuit 50, transistor 51 is operable when enabled to limit the voltage swing at the gate of the PUT device 40 to a predetermined value whenever a flame is provided at the burner 15. The base of transistor 51 is connected to the junction of resistors 52 and 53, which are serially connected from the anode of the PUT device 40 to conductor L5, forming a voltage divider at the base of transistor 51, with the base potential being determined by the charging of capacitor 46. Transistor 51 has its collector-emitter circuit connected between the gate of the PUT device 40 and conductor L5 over normally open contacts R3B of relay R3. Whenever relay R3 is operated, then when the base-emitter turnon potential is exceeded, the transistor 51 conducts, clamping the gate to PUT device 40 to the potential on conductor L5. The action of the over-signal clamping circuit 50 prevents pre-mature firing of the PUT device 40 when a main burner flame bridges the gap 56, which would otherwise result in the deenergization of relay R2.

Relays R2 and R3 are double-pole, double-throw relays. For relay R2, contacts R2A and R2B employ a common armature of the relay such that whenever contact R2A is closed, contact R2B is open. Also, should contact R2B become welded, contact R2A cannot reclose thereby preventing energization of the interlock circuit 18 on the next call for heat.

In relay R3, contacts R3A and R3C employ a common armature such that when contact R3A is closed, contact R3C is open. If contact R3C becomes welded, contact R3A cannot reclose thereby preventing energization of the interlock circuit 18 on the next call for heat.

Operation

When a 24 VAC power signal is applied to terminals 81 and 82 of the control circuit 10, the flame sensing circuit 20 is energized over transformer T1. When contacts THS are open, and in the absence of a flame at the pilot outlet or the main burner, relays R1–R3 are unoperated and the valves are deenergized.

When contacts THS close in response to a request for heat, the 24 VAC signal is applied to conductors L1 and L2 over normally closed contacts R2A of relay R2 and since contacts R3A are closed, heater 21 of the warp switch WS is energized, initiating a trial for ignition interval. The interval, typically 15 to 20 seconds, is defined by the heating time of the warp switch heater 21. Also, relay R1 operates closing contacts R1A, energizing the operate coil 17 of the pilot valve 12 of the redundant valve assembly, which opens to supply fuel to an inlet of the main valve 14 and to the pilot burner 13. The igniter circuit 16 is also energized. Further, contacts R1B close to prepare a holding path for relay R1 in shunt with contacts R2A.

With reference to the igniter circuit 16, when line L1' is positive relative to line L2, capacitor 64 is charged over diode 65 to a voltage of approximately 37 volts. When line L2 becomes positive relative to line L1' during the next negative half cycle of the AC line signal, capacitor 62 is charged over capacitor 64, resistor 66 and diode 69, with the charge on capacitor 64 being transferred to capacitor 62, such that capacitor 62 is charged to approximately 74 volts. During the next half cycle when line L1' is again positive relative to line L2 and the AC signal begins to decrease from its maximum value, the voltage on capacitor 62 is greater than the supply voltage, permitting current to flow from the positive side of the capacitor 62 at point 91 through resistor 66, capacitor 64, the secondary winding 86 of the input transformer T3, and over contacts R2D, resistor 76, diode 77 and resistor 78 to the other side of capacitor 62, establishing a positive voltage at the gate of the SCR device 63 which then conducts.

Capacitor 62 then discharges over the primary winding 74 of the transformer T2 and the SCR device 63, inducing a voltage in the secondary winding 75 of the transformer T2, activating the electrodes 68 to generate an ignition spark. The igniter circuit 16 continues to operate in the manner described above, providing sparks until the relay R2 is operated in response to the flame sensing circuit when the fuel is ignited.

When relay R2 operates and opens contacts R2D, capacitor 62 is charged and discharged, initially, over the timing capacitor 71. That is, when the voltage on capacitor 62 becomes greater than the supply voltage during the positive half cycles of the AC line signal, current flows from the positive side of the capacitor 62 through resistor 66, capacitor 64, the secondary winding 84 of transformer T3, capacitor 71, diode 77 and resistor 78 to the other side of capacitor 62, providing a turnon voltage for SCR device 63 for permitting capacitor 62 to discharge over the ignition transformer T2 to generate a spark. The sparking continues until capacitor 71 becomes fully charged at which time current flow ceases and the SCR device 63 is not triggered, inhibiting further spark generation. In one embodiment, the component values were selected to allow the igniter circuit 16 to provide sparks for a period of ten seconds after the operation of relay R2.

When power is applied to the flame sensing circuit 20, and in the absence of a flame, then when conductor L4 starts to swing positive, current flows from conductor L4 over resistor 47 and capacitor 46, charging the capacitor 46. Capacitor 46 charges during each postive half cycle of the AC signal, providing an increasing potential at the anode of the PUT device 40. In the absence of a pilot flame, capacitors 48 remain discharged, and the PUT device 40 conducts early in the positive half cycles of the AC signal and before capacitor 46 has charged to a value sufficient to trigger the SCR device 44 into conduction. Thus, relay R2 is maintained unoperated. If a flame fails to become established during the trial for ignition interval, the warp switch WS deenergizes the pilot valve 12 locking out the system, and enables the alarm device 11.

When a pilot flame is established before the warp switch WS operates, then during the next positive half cycle of the AC signal applied between conductors L4 and L5, when conductor L4 swings positive, current flows from conductor L4 through resistor 54, over sensing electrode 55 and the pilot flame to point 94, and over capacitors 48 to conductor L5, charging the capacitors 48. The voltage across capacitors 48 at point 94, which is connected over resistor 42 to the gate of the PUT device 40, establishes a gate potential for the PUT device 40.

During the same half cycle, capacitor 46 is charged over a path extending from conductor L4 over resistor 47 and capacitor 46 to conductor L5, establishing an anode potential for the PUT device 40. The values of capacitors 48 and 46 are selected such that some time before the peak of the AC line signal, during the first half cycle thereof, the anode to gate potential of the PUT device 40 exceeds +0.6 volts so that the PUT device 40 conducts, permitting capacitor 46 to discharge over the PUT device 40. At such time, capacitor 46 is charged to a voltage sufficient to effect the enabling of the SCR device 44.

When SCR 44 conducts, the operate coil 45 of relay R2 is energized, and relay R2 operates to close contacts R2C to energize the delay circuit 22, and to open contacts R2D to disable the igniter circuit 16. Also, contacts R2A open and contacts R2B close so that relay R1 remains energized over the holding path over its contacts R1B, resistor 33 amd contacts R2B.

Once the pilot flame has been established, the flame sensing circuit 20 provides enabling pulses to the gate of the SCR device 44 during positive half cycles of the AC signal. During negative half cycles, the SCR device 44 is cutoff, and relay R2 is maintained energized by the energy stored in the relay magnetic field, resulting in current flow through the "free-wheeling" diode 57' and relay coil 45 as the magnetic field decays.

When contacts R2C close, the 24 VAC signal supplied to conductor L1' is extended to the delay circuit 22. During positive half cycles of the AC signal, current flow over diode 31, capacitor 27 and resistor 28 charges capacitor 27. Initially the potential at the gate of the PUT device 25 is sufficiently greater than the potential at the anode of the PUT device 25 established by the voltage divider formed by the operated winding 32 of relay R3 and resistor 29. Thus, the PUT device is maintained cut off. As capacitor 27 charges during successive cycles of the AC signal, the potential at the gate of the PUT device 25 decreases. The time constat of resistor 28 and capacitor 27 is selected to provide a delay of about 3 seconds before the PUT device 25 is enabled to effect the operation of relay R3.

During the delay for the delay circuit 22, a check is made for a leak condition for the main valve 14. After relay R2 operates to enable the delay circuit 22, relay R3 is maintained deenergized for the 3 second delay period. Accordingly, contacts R3B remain open so that the over-signal clamping circuit 50 is disabled. If the main valve 14 is leaking, fuel is supplied to the main burner 15 and is lit by the pilot flame producing a large flame. Such condition reduces the impedance of the current path over the flame sensing electrode 55 causing increased current flow to the gate of the PUT device 40. Thus, for the condition where such leakage occurs after relay R2 has operated, but before the end of the three second delay time, the PUT device 40 is maintained cutoff, causing relay R2 to release. When contacts R2C open, the timing circuit 22 is deenergized keeping relay R3 deenergized. After the heating time of the warp switch heater 21, the warp switch operates contacts WSA and WSB to deenergize the pilot valve 12, providing 100% shut off of fuel, and the alarm device 11 is enabled.

It is apparent that should the main valve 14 be leaking prior to the energization of the circuit 10, then when the pilot valve 12 is operated and a pilot flame is established, fuel leaking to the main burner is lit by the pilot flame, and the over-signal clamping circuit 50 is effective to maintain the PUT device 40 cutoff. Thus, relay R2 is deenergized and the system is deactivated in the manner described above.

Assuming there is no leakage from the main valve 14, the delay circuit 22 energizes relay R3 after the three second delay, and contacts R3A open to deenergize the warp switch heater 21, and contacts R3C close to energize the main valve 14. Also, contacts R3B close to enable the over-signal clamping circuit 50.

When the over-signal clamping circuit 50 is enabled, then, as capacitor 46 charges during each positive half cycle of the AC signal, the potential at the base of transistor 51 rises, causing the transistor to conduct when the base-emitter turnon potential is reached. When transistor 51 conducts, a discharge path is provided for capacitor 46, which discharges. As capacitor 46 discharges, the gate potential for the PUT device 40 decreases until the anode-gate potential is 0.6 volts at which time the PUT device 40 conducts, discharging the capacitor 46 and pulsing the SCR device 44 into conduction. Accordingly, relay R2 is maintained energized.

When the heating demand has been met, contacts THS open, deenergizing the circuit 10, causing the main valve 14 and the pilot valve 12 to drop out, and causing relays R1 and R3 to be deenergized. When the main valve 14 and the pilot valve 12 drop out, the main burner flame and the pilot flame are extinguished. However should a leak develop in the pilot valve 12, then when the circuit 10 is deenergized, the pilot flame remains established and relay R2 is maintained operated by the flame sensing circuit 20. Accordingly, the next time the circuit 10 is activated in response to operation of contacts THS, contacts R2A are open and the system cannot restart. The same effect is provided for a failure of the flame sensing circuit 20 where the relay R2 is permitted to be operated in the absence of a flame.

For a flame out condition, relay R2 drops out deenergizing relay R3 and enabling the igniter circuit 16, and the system recycles as indicated above with the warp switch WS deenergizing the pilot valve 12 if the flame is not reestablished within the timeout of the warp switch.

In the event of a fast line interruption, the interlock arrangement and the delay circuit 22 permit the system to recycle without lockout if a flame is reestablished before the timeout of the warp switch WS. Following such power interruption, and assuming a flame remains established, then when power is restored, the relay R2 is operated before relay R1 operates, interrupting the energizing path for relay R1 and maintaining the pilot valve deenergized. Thus, fuel cannot flow to the pilot outlet or the main burner and, in the absence of a leak condition for the pilot valve, the flame will be extinguished. The system then recycles as above as soon as relay R2 drops out following loss of flame.

In the event of a failure condition following a successful start-up, such as the welding together of contacts R2C which control the enabling of the delay circuit 22, then when the circuit 10 is deactivated with the opening of contacts THS, contacts R2A cannot reclose. Thus, the next time that contacts THS close, the energizing path for the interlock circuit 18 is interrupted and the system cannot restart. Should contacts R3C, which control the energizing of the main valve 14 become welded, contacts R3A cannot reclose and the interlock circuit 18 cannot be energized on the next call for heat. In either case, the pilot valve 12 is maintained deenergized, preventing fuel supply to either the pilot outlet or the main burner.

I claim:

1. In a fuel ignition system including a pilot valve operable when energized to supply fuel to a pilot outlet for ignition to establish a pilot flame, and a main valve operable when energized to supply fuel to a burner apparatus for ignition by the pilot flame to provide a flame at said burner apparatus, a control circuit comprising interlock means including first switching means operable when enabled to energize said pilot valve, and to prepare an energizing path for said main valve, activate means operable in response to a request for heat to enable said first switching means, second switching means, flame sensing means for maintaining said second switching means disabled in the absence of a flame at said pilot outlet to permit said first switching means to be enabled by said activate means and for enabling said second switching means to operate when a pilot flame is established at said pilot outlet to prevent said first switching means from being enabled by said activate means, and delay means enabled by said second switching means when a pilot flame is sensed to effect the energization of said main valve at the end of a time interval initiated by the operation of said second switching means, said flame sensing means preventing the energization of said main valve in the event that a flame is provided at said burner apparatus during said time interval.

2. A system as set forth in claim 1 wherein said interlock means further includes timeout means energized in response to said activate means to define a trial for ignition interval and to cause interruption of the supply of fuel to at least said pilot outlet if a pilot flame fails to be established during said trial for ignition interval.

3. A system as set forth in claim 2 wherein said pilot valve and said main valve comprise a redundant valve structure wherein fuel is supplied to said main valve over said pilot valve only when said pilot valve is operated, said timeout means deenergizing said pilot valve at the end of said trial for ignition interval in the absence of a pilot flame to prevent fuel from being supplied to said pilot outlet and said burner apparatus.

4. A system as set forth in claim 2 wherein said delay means includes third switching means operable when enabled to energize said main valve, and enabling means responsive to said second switching means to enable said third switching means, said enabling means including timing means for delaying the enabling of said third switching means for said time interval after said second switching means operates.

5. A system as set forth in claim 4 wherein said flame sensing means includes means for causing said second switching means to disable said delay means and to cause said timeout means to deenergize said pilot valve if a flame is provided at said burner apparatus before said third switching means is enabled.

6. A system as set forth in claim 4 wherein said third switching means is operable when enabled to deenergize said timeout means.

7. A system as set forth in claim 4 wherein said second and third switching means include means for providing an energizing path for said interlock means to permit enabling of said first switching means, the enabling of said first switching means being prevented whenever said energizing path for said interlock means is interrupted when said activate means operates.

8. In a fuel ignition system including a pilot valve operable when energized to supply fuel to a pilot outlet for ignition to establish a pilot flame, and a main valve operable when energized to supply fuel to a burner apparatus for ignition by the pilot flame to provide a flame at said burner apparatus, a control circuit comprising interlock means including first switching means operable when enabled to energize said pilot valve, activate means for enabling said first switching means, second switching means, flame sensing means energized continuously and independently of said activate means for causing said second switching means to be disabled in the absence of a flame at said pilot outlet to permit said first switching means to be enabled by said activate means and for causing said second switching means to be enabled whenever a pilot flame is provided at said pilot outlet to prevent said first switching means from being enabled by said activate means, and delay means responsive to said second switching means to effect the energization of said main valve at the end of a time interval initiated by the enabling of said second switching means, said flame sensing means preventing the energization of said main valve in the event that a flame is provided at said burner apparatus during said time interval.

9. A system as set forth in claim 8 wherein said flame sensing means includes a controlled switching device and timing means for controlling said controlled switching device to effect enabling of said second switching means when a pilot flame is established and to prevent enabling of said second switching means in the absence of a pilot flame.

10. A system as set forth in claim 9 wherein said flame sensing means includes limiting means operable when enabled to permit said controlled switching device to maintain said second switching means enabled when a flame is provided at said burner apparatus, said limiting means being disabled during said time interval preventing said controlled switching device from maintaining said second switching means enabled when a flame is provided at said burner apparatus during said time interval.

11. In a fuel ignition system including a pilot valve operable when energized to supply fuel to a pilot outlet for ignition to establish a pilot flame at said pilot outlet, and a main valve operable when energized to supply fuel to a burner apparatus for ignition by the pilot flame to provide a flame at said burner apparatus, a control circuit comprising interlock means including first switching means, activate means for enabling said first switching means over a first circuit path to complete a second circuit path to energize said pilot valve, second switching means, flame sensing means for causing said second switching means to complete said first circuit path in the absence of a flame at said pilot to permit said first switching means to be enabled and for causing said second switching means to interrupt said first circuit path whenever a pilot flame is provided at said pilot outlet thereby preventing enabling of said first switching means, and delay means including third switching means and enabling means operable when connected to said second circuit path to enable said third switching means to connect said main valve to said second circuit path for energization thereover, said second switching means connecting said enabling means to said second circuit path after a pilot flame is provided, said enabling means including timing means to delay the enabling of said third switching means for a time interval after said enabling means is connected to said second circuit path, said flame sensing means including limiting means for preventing the energization of said main valve in the event that a flame is provided at said burner apparatus during said time interval.

12. A system as set forth in claim 11 wherein said interlock means includes timeout means connected in said first circuit path, said timeout means being energized over said first circuit path in response to operation of said activate means to define a trial for ignition interval during which said pilot valve is energized, and to deenergize said pilot valve at the end of said trial for ignition interval in the absence of a pilot flame.

13. A system as set forth in claim 12 wherein said third switching means comprises a switch device having first normally closed contacts connected in said first circuit path and operable to override said timeout means when a pilot flame is provided during said trial for ignition interval, and second normally open contacts for connecting said main valve to said second circuit path, said first and second contacts employing a common armature of said switch device whereby should said second contacts become welded together, said first contacts cannot reclose, thereby preventing the enabling of said interlock means.

14. A system as set forth in claim 13 wherein said switch device has third normally open contacts connected to said limiting means to override said limiting means during said time interval and to enable said limiting means after said time interval.

15. A system as set forth in claim 11 wherein said second switching means comprises a switch device having first normally closed contacts connected in said first circuit path and second normally open contacts for connecting said delay means to said second circuit path, said first and second contacts employing a common armature of said switch device whereby should said second contacts become welded together, and first contacts are prevented from reclosing thereby preventing the energizing of said interlock means.

* * * * *